US011832678B2

(12) United States Patent
Kronenberger et al.

(10) Patent No.: US 11,832,678 B2
(45) Date of Patent: Dec. 5, 2023

(54) ACCESSORY FOR BASEBALL-STYLE CAP

(71) Applicants: Ronald Kronenberger, Eldorado, IL (US); Samuel Kronenberger, Highland Park, IL (US); Daniel M. Colvin, Wake Forest, NC (US)

(72) Inventors: Ronald Kronenberger, Eldorado, IL (US); Samuel Kronenberger, Highland Park, IL (US); Daniel M. Colvin, Wake Forest, NC (US)

( * ) Notice: Subject to any disclaimer, the term of this patent is extended or adjusted under 35 U.S.C. 154(b) by 0 days.

(21) Appl. No.: 16/507,426

(22) Filed: Jul. 10, 2019

(65) Prior Publication Data

US 2020/0383420 A1 Dec. 10, 2020

Related U.S. Application Data

(60) Provisional application No. 62/859,361, filed on Jun. 10, 2019.

(51) Int. Cl.

| | |
|---|---|
| ***A42C 5/02*** | (2006.01) |
| ***A42B 1/02*** | (2006.01) |
| ***A42B 1/002*** | (2021.01) |

(52) U.S. Cl.

CPC ..... *A42C 5/02* (2013.01); *A42B 1/002* (2013.01); *A42B 1/02* (2013.01)

(58) Field of Classification Search

CPC .... A42C 5/00; A42C 5/02; A42B 1/00; A42B 1/02; A42B 1/002; A42B 1/24; A42B 1/241

USPC ... 2/46, 63, 181, 181.2, 181.4, 181.6, 181.8, 2/182.1, 182.2, 182.3, 182.4, 182.5, 2/182.6, 182.7, 182.8, 183, 195.1, 195.5

See application file for complete search history.

(56) References Cited

U.S. PATENT DOCUMENTS

| | | | | | |
|---|---|---|---|---|---|
| 1,731,025 | A * | 10/1929 | Rockwood | A42C 5/02 | 2/184 |
| 5,481,760 | A * | 1/1996 | Wood, Jr. | A42B 1/0181 | 2/195.5 |
| 5,887,284 | A * | 3/1999 | Simmons | A42C 5/02 | 2/184 |
| 5,920,910 | A * | 7/1999 | Calvo | A42C 5/02 | 2/DIG. 11 |
| 7,213,270 | B2 * | 5/2007 | Lee | A42C 5/02 | 2/175.1 |
| 7,774,861 | B1 * | 8/2010 | Schmidt | A42C 5/02 | 2/181.2 |
| 7,941,870 | B2 * | 5/2011 | Kingto | A42C 5/02 | 2/181 |

(Continued)

*Primary Examiner* — F Griffin Hall

(74) *Attorney, Agent, or Firm* — Wood, Phillips, Katz, Clark & Mortimer

(57) ABSTRACT

The combination of a headwear piece having: a) a crown with a wall having an inside surface bounding a space for receiving a part of a wearer's head; and b) a rim/bill projecting from a forward region of the crown; and an accessory having a body with a thickness between front and rear sides and made from a material that substantially blocks migration of moisture therethrough. The accessory has an array of small openings extending through the body thickness to provide for air passage. The accessory is configured to be placed in an operative position against the inside surface of the crown wall at the forward region of the crown to reduce contaminant transmission from a wearer's head to the inside surface of the crown wall at the forward region.

22 Claims, 5 Drawing Sheets

(56) References Cited

U.S. PATENT DOCUMENTS

| | | | | |
|---|---|---|---|---|
| 8,112,821 | B1 * | 2/2012 | Barry | A42C 5/02 2/181 |
| 9,220,308 | B2 * | 12/2015 | Boyle | A41D 20/00 |
| 2007/0245457 | A1 * | 10/2007 | Gelera | A42C 5/02 2/181 |
| 2012/0297519 | A1 * | 11/2012 | Strombo | A42C 5/02 2/181 |
| 2015/0335085 | A1 * | 11/2015 | Williams | A42B 1/002 2/195.5 |

* cited by examiner

ACCESSORY FOR BASEBALL-STYLE CAP

BACKGROUND OF THE INVENTION

Field of the Invention

This invention relates to baseball-style caps and, more particularly, to an accessory usable in conjunction with the cap to protect, and maintain the shape of, the cap.

Background Art

Baseball-style caps have evolved into one of the most commonly worn types of headwear worldwide. Aside from being worn by individuals playing the game of baseball, these caps are worn by individuals participating in many different activities and in many different environments.

For example, many individuals simply enjoy wearing a cap, oftentimes even indoors. Baseball-style caps are commonly worn in health clubs to obscure viewing of the tops of wearers' heads, control their hair, or simply to make a fashion statement. These caps are worn outside additionally as protection from outside elements, including obstructions that might be encountered in activities ranging from casual walking to ones performed under extreme conditions. The crown portion of the baseball-style cap effectively protects the top region of the wearer's head while the forwardly projecting rim/bill affords additional protection, primarily of the facial region, including blocking exposure to primarily atmospheric moisture and sun glare.

With casual dress codes in many businesses, baseball-style caps are often worn inside throughout a work day.

The ever-increasing popularity of this type of headwear has led many entities to exploit its presence for advertising purposes. Businesses commonly place logos or other business identification on the caps for employees and offer the same to non-employees to promote business and/or product identity and awareness.

This concept has migrated into the business category that offers high-end apparel. Still further, these baseball-style caps with business identities are often collector items. For example, individuals will often collect a baseball-style cap with a business identity as a souvenir from a visit to a particular location, a business, etc.

Golf courses have become a popular place for offering memento-type caps. This setting is ideal since baseball-style caps are commonly worn by golfers, who are inclined to purchase caps as both a souvenir and a functional item. Ideally, such baseball-style caps would have the ability to be worn on a regular basis while maintaining their relatively pristine condition that distinguishes them as a collectable souvenir.

Baseball-style caps are commonly displayed in a manner that maintains a cup shape for the crown which highlights the convex frontal region thereof behind the rim/bill, in which region identifying logos or other information is most commonly located. Thus, a baseball-style cap displayed in a golf pro shop will generally be in a shape as it would appear on the head of the wearer.

To accomplish this, it is common to place a removable shape retaining element within the crown space to replicate the curvature at the front of the cap when it is worn. Relatively complex stiffeners have been devised which must be removed before being test worn. These types of structures are relatively expensive, are inconvenient in the sense that they must be placed in and removed from the crown space, and must be stored for reuse after sale of a particular cap occurs.

Alternatively, cardboard stiffeners have been used. These cardboard components are generally considered to be in the nature of packaging, which is disposable by the purveyor or purchaser after sale of the cap. With these cardboard stiffeners, there are different models practiced in promotion of the caps.

The cardboard stiffener might be removed before display, in which event the cap is likely to have a more collapsed appearance which does not highlight its construction. If the stiffeners are left in place at the displays, a potential purchaser must either remove the insert or try the cap on with the insert in place. In the former case, the cloth front region of the inside of the crown may become soiled with perspiration and dirt over time, which is unsanitary and detracts from the appearance of the cap. If the insert is left in place, it will generally be abrasive on the wearer's head. Aside from noticeably changing the fit in the event the insert is bulky, it detracts from the feel of the cap, which may discourage sales. Further, the cardboard typically used in such inserts is porous and thus the insert itself, if left in place, becomes soiled and detracts from the appeal of the cap if not replaced. Regardless of the manner of use, the cardboard insert becomes an item that must be disposed of by the purveyor or the ultimate purchaser.

It is known to provide aftermarket sweat pads that might be strategically placed at the front region of the inside of the crown to protect the cap by absorbing and accumulating perspiration and foreign matter from different wearers as they don the cap. Such sweat pads are commonly made from cloth which, while desirable for its absorbent characteristics, retains contaminants. The purveyor is faced with the options of either leaving an original sweat pad in place over time or periodically replacing the sweat pads after ongoing inspection, which is an inconvenience which often leads to lax supervision of the condition of the caps.

The end user faces the same issues when deciding whether to use an aftermarket addition to the crown to preserve condition. For example, an individual who obtains a valuable souvenir item may wish to periodically wear the cap while preserving, as much as possible, its original state. Use of a sweat pad is an inconvenience and requires a user to clean or replace the sweat pad periodically as it absorbs contaminants. Even then the sweat pads, by reason of their cloth construction, tend to allow bleeding of perspiration and other contaminants through the material to contact the inside crown surface, which eventually leads to staining, loss of color, wrinkling, etc.

The headwear industry continues to contend with the above problems due to the lack of an aftermarket solution that adequately addresses the same.

SUMMARY OF THE INVENTION

In one form, the invention is directed to the combination of: a headwear piece having: a) a crown with a wall having an inside surface bounding a space for receiving a part of a wearer's head with the headwear piece in an operative position; and b) a rim/bill projecting from a forward region of the crown; and an accessory having a body with a thickness between front and rear sides and made from a material that substantially blocks migration of moisture from the rear side to the front side. The accessory further includes a component applied to the body to limit migration of moisture and/or loose matter from a wearer's head to the headwear piece. The accessory is configured to be placed in an operative position against the inside surface of the crown wall at the forward region of the crown to reduce contaminant transmission from a wearer's head to the inside surface of the crown wall at the forward region.

In one form, the body material is plastic.

In one form, the accessory and headwear piece are configured so that the accessory can be maintained in the operative position without requiring any separate fasteners.

In one form, the accessory and headwear piece are configured so that the accessory can be changed from a fully separated position into the operative position by a press fit step.

In one form, the accessory and headwear piece are configured so that the accessory in the operative position can be drawn away from the headwear piece to be fully separated from the headwear piece.

In one form, the accessory and headwear piece are configured so that with the accessory in the operative position the accessory generates forces on the forward region of the crown that produce a desired curved shape at the forward region of the crown.

In one form, the accessory body has a sheet construction.

In one form, the body material is flexible and shape-retentive.

In one form, the body has an array of small openings extending through the body thickness to provide air passage through the thickness of the body. The small openings in the array are substantially uniformly spaced from each other.

In one form, the small openings have the same size and shape.

In one form, the small openings each can be circumscribed by a circle with a diameter less than 3/16 of an inch.

In one form, there is at least one opening extending through the body thickness to provide for air passage through the thickness of the body.

In one form, the accessory is nominally crescent shaped.

In one form, the crown defines an opening with a diameter through which a wearer's head is directed into the crown space. With the accessory in the operative position, the accessory extends around less than an entirety of the diameter of the crown opening.

In one form, the accessory in the operative position extends between 150° and 210° around the diameter of the crown opening.

In one form, the crown wall has an outer layer that is exposed at the forward region and a layer that is folded upwardly behind the outer layer to produce an upwardly opening pocket. The accessory in the operative position is extended into the pocket.

In one form, the accessory has a perimeter edge. There is a discrete notch in the peripheral edge to facilitate bending of the accessory in the operative position.

In one form, the accessory in the operative position has spaced sides. The small openings are provided in a regular pattern. There is a discrete area of the body between the sides of the accessory that has no openings and provides an interruption of the regular pattern. Visible information is located on the discrete area.

In one form, the visible information is a word and/or a logo.

In one form, the crown is made from a flexible fabric material.

In one form, the component has a moisture absorbing layer applied to at least a part of at least one of the front and rear sides of the body.

In one form, the component has at least one moisture absorbing layer applied to the body at each of the front and rear sides of the body.

In one form, the combination is provided in further combination with a cooling piece on the body of the accessory that is at a temperature below a temperature of an atmosphere in which the headwear piece is worn and below a temperature of the body of the accessory.

In one form, the combination further includes a drape layer that overlies at least a part of the accessory and at least a part of the inside surface of the crown that is exposed to a head of a wearer with the headwear piece in the operative position.

In one form, the drape layer is connected to the inside surface of the crown.

In one form, the drape layer is adhered to the inside surface of the crown.

In one form, the drape layer is connected to the accessory body.

In one form, the drape layer is adhered to the accessory body.

In one form, the drape layer is a moisture absorbing material.

In one form, the invention is directed to the combination of a headwear piece having: a) a crown with a wall having an inside surface bounding a space for receiving a part of a wearer's head with the headwear piece in an operative position: and b) a rim/bill projecting from a forward region of the crown; and an accessory having a body with a thickness between front and rear sides and made from a material that substantially blocks migration of moisture from the rear side to the front side. The accessory and headwear piece are configured so that with the accessory in the operative position, the accessory generates forces on the forward region of the crown that produce a desired curved shape at the forward region of the crown. A moisture absorbing material is applied to at least a part of at least one of the front and rear sides of the body.

In one form, the body material is flexible and shape-retentive.

In one form, the body has an opening through the body thickness to provide for air passage through the thickness of the body.

DETAILED DESCRIPTION OF THE PREFERRED EMBODIMENT

Figure 1:
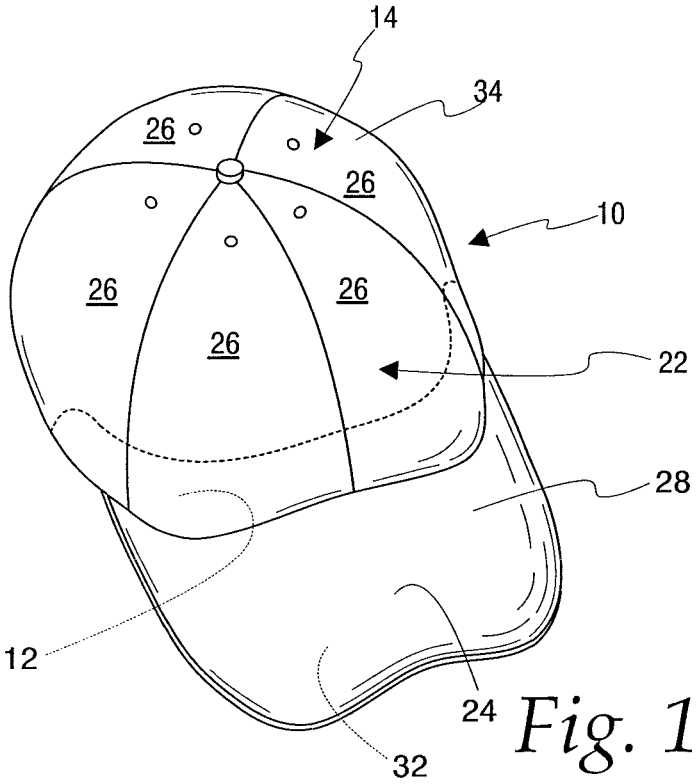
FIG. 1 is a perspective view of one headwear piece, in the form of a baseball-style cap, with an accessory, according to the invention, in an operative position thereon.
Figure 2:
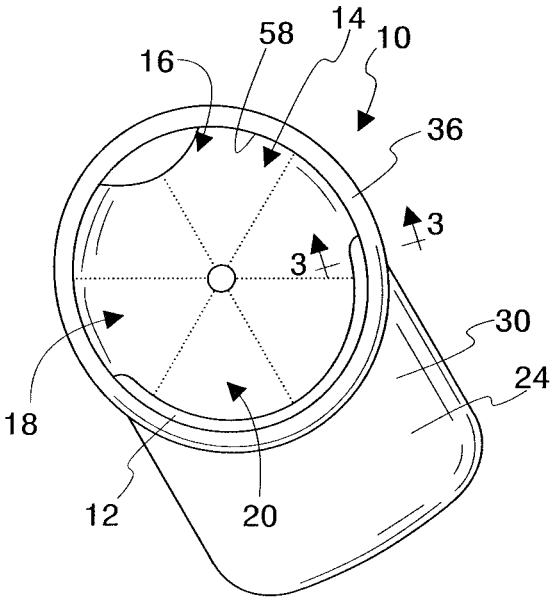
FIG. 2 is an underside perspective view of the headwear piece in FIG. 1.
Figure 3:
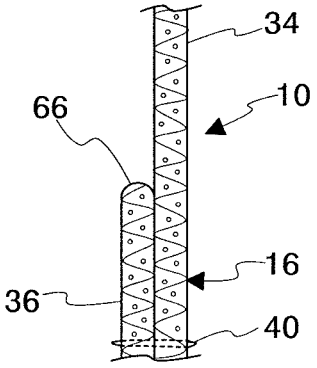
FIG. 3 is an enlarged, cross-sectional view of a wall on the headwear piece taken along line 3-3 of FIG. 2 and inverted from the FIG. 2 orientation.
Figure 5:
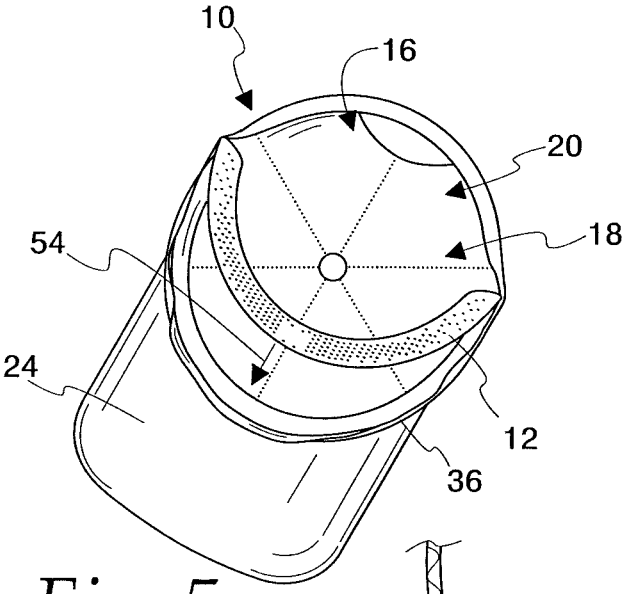
FIG. 5 is an underside perspective view of the headwear piece in FIGS. 1-4 and with the accessory being directed into an operative position thereon.
Figure 7:
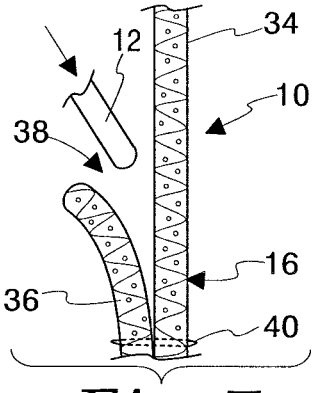
FIG. 7 is a view as in FIG. 3 wherein a layer on the wall has been reconfigured to create a pocket for placement of the accessory.

In FIGS. 1-7, one form of the invention is depicted, consisting of a headwear piece 10 and an accessory 12 used in conjunction therewith.

The depicted headwear piece 10 is what is conventionally referred to as a "baseball-style cap". The headwear piece 10 has a crown 14 with a wall 16 having an inside surface 18 bounding a space 20 for receiving a part of a wearer's head with the headwear piece 10 in an operative position on the wearer's head.

The invention is not limited to the precise construction depicted. For example, the crown 14, while forming a "cup shape", may extend less than fully around a wearer's head, as with a visor configuration. An important aspect of the headwear piece 10 is that it has a forward crown region 22 from which a rim/bill 24 projects in the general arrangement depicted.

The precise details of the construction of the headwear piece 10 are not critical to the present invention. It suffices to say that the crown 14 has a generally flexible configuration made up of flexible fabric gores 26 which are sewn together to produce the depicted cup shape. The rim/bill 24 commonly has upper and lower fabric layers 28, 30 sewn together to sandwich therebetween a shape retentive component 32. The rim/bill 24 is connected to the crown 14 typically by sewing using conventional high strength threads.

As depicted, the wall 16 has an outer layer 34 that is exposed, including at the forward region 22, and a separate layer 36 that is folded upwardly behind the outer layer 34 to provide an upwardly opening pocket 38 therebetween. As depicted, the layers 34, 36 are separate components held together by stitching 40. The layers 34, 36 could be made up of a single component that is wrapped against itself. This type of detail is not critical to the present invention, so long as a pocket 38 is formed.

Additional details regarding headwear of this type are shown in a current portfolio of U.S. patents assigned to American Needle in Buffalo Grove, Illinois, the disclosures of which are incorporated herein by reference.

It should be noted that, for simplicity purposes, only the critical components are depicted in the drawings and described herein. This type of headwear may incorporate multiple additional layers, including other fabrics, padding, sweatbands, etc. The invention is contemplated for use in virtually all such different designs so long as they have the basic components as herein described to be of significance.

The accessory 12 has a body 42 with a flat sheet construction. While not required, the body 42 has a substantially uniform thickness t between front and rear sides 44, 46, respectively.

The body 42 is made from a flexible shape-retentive material. The accessory 12 can be made with a flat shape and size that are strategically selected to perform the functions described below. Alternatively, the body may be pre-formed into a non-flat shape to perform the function described hereinbelow. Whether flat or non-flat, the body 42 is readily flexible but tends back towards its original set shape.

Figure 6:
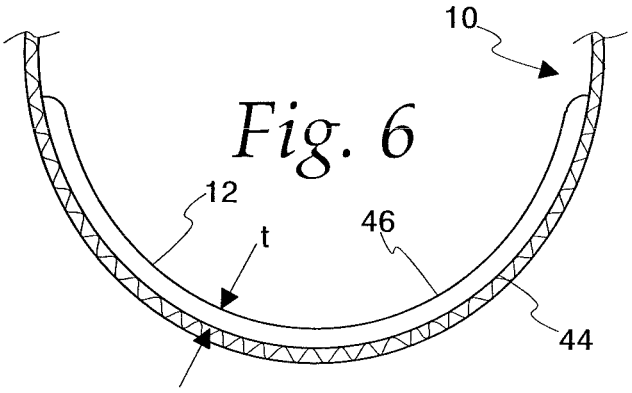
FIG. 6 is an enlarged, fragmentary, cross-sectional, plan view of the headwear piece in FIGS. 1-5 with the accessory in an operative position on a crown thereon.

As depicted, the body 42 is nominally crescent shaped with spaced, rounded ends/sides 48, 50. The shape and dimensions of the body 42 relative to the shape and dimension of the crown 14 are selected so that with the convex perimeter portion 52 of the body 42 advanced into the pocket 38, as indicated by the arrow 54 in FIG. 5, the ends 48, 50 must be flexed towards each other. In other words, the body 42 must be bent into the more pronounced "U" shape as shown in FIG. 6 to be placed into the operative position of FIG. 6, wherein substantially the entire length of the convex perimeter portion 52 resides within the pocket 38, spanning the forward crown region 22. By releasing this force on the body 42, the residual forces stored in the body 42 tend to stretch the layer 34 at the forward crown region 22 into a symmetrically curved shape as viewed from the front of the headwear piece 10.

Because of the pocket arrangement and the captive force produced on the sides of the body 42 bent into the "U" shape, as seen most clearly in FIG. 6, the body can be maintained against the inside surface 18 of the crown 14 in the operative position without requiring any separate fasteners. Frictional forces between the body 42 and headwear piece 10 positively hold the accessory 12 in place. Thus, changing of the accessory from a fully separated position relative to the headwear piece 10 into the operative position involves a simple press fit step.

While fasteners might be used to secure the connection between the accessory 12 and headwear piece 10, in the absence of the use of such fasteners, the accessory 12 can be simply drawn away from the headwear piece from its operative position to thereby be fully separated from the headwear piece 10.

The width W of the accessory body 42 is selected so that in the operative position, as shown in FIG. 1, the accessory 12 overlies most, or all, of that portion of the inside surface 18 of the forward crown region 22 that is contacted by a wearer's forehead. Thus, the accessory 12 shields the inside surface 18 from sweat and any other foreign material or substance that might be present at the wearer's forehead region.

The material making up the accessory body 42 is preferably one that will substantially block migration of moisture from the rear side of the body 42 fully through the thickness t to the front side 44 thereof.

The body 42 may be made from one or more layers with different properties. For example, the rear side 46 may be made from a material that is comfortable when placed against the user's skin. That layer or another layer may afford the resistance to moisture migration. Shape retention may be afforded by one or both of these layers or a separate layer.

In the depicted form, a single layer defines the body 42. In one form, the layer is made from a plastic material that lends itself to being removed and cleaned.

To incorporate a level of "breathability" into the accessory 12, at least one opening, and as depicted an array of small openings 56, extend through the body thickness, each to provide an air passage between the sides 44, 46 of the body 42. As depicted, the openings 56 are arranged in patterns wherein the openings 56 are uniformly spaced from each other. As depicted, the openings 56 are arranged in regular diamond groupings which aside from allowing "breathability" over a significant area contribute to aesthetics.

As depicted, the openings 56 are all the same size and shape. However, this is not a requirement. One preferred opening size is one that can be circumscribed by a circle with a diameter less than 3/16 of an inch. The openings may be laser cut or otherwise conventionally formed.

Other opening configurations might be utilized with different sizes, numbers, and shapes. For example, elongate shapes such as slits might be used. Larger rounded shapes might be used. The opening number, size, shape, etc. are dictated in part by what other structure(s) is incorporated into the accessory, as described in different embodiments, below.

The crown 14 defines an opening 58 through which a wearer's head is directed into the crown space 20. In a preferred form, the accessory 12 in the operative position extends around less than the full diameter of the crown opening 58.

In a preferred form, the accessory 12 in the operative position extends between 150° and 210° around the diameter of the crown opening 58.

As noted above, while the outer layer 34 in this embodiment also defines part of the inside surface 18 to be protected by the accessory 12, the invention contemplates any number of additional layers that might be incorporated to define exposed surfaces. The only significant aspect is that the accessory 12, and/or attachments thereto, as described below, reside between the wearer's head and the inside wall surface bounding the space 20 at the forward crown region, thereby to reduce contaminant transmission from the wearer's head to the inside surface of the crown wall 16 at the forward region 22.

The precise shape and dimension of the perimeter edge 59 of the accessory 12 are dictated by the particular headwear piece 10. As noted above, the objective is to cause the operably positioned accessory to generate forces in the forward region of the crown that produce a desired curved shape thereat.

Thus, preferably the accessory 12 serves the dual purpose of attractively shaping the forward crown region 22 and also providing a barrier against contaminant transmission to the fabric material making up the headwear piece 10.

To facilitate the conformity of the accessory to the headwear piece 10, in this embodiment, a discrete notch 60 is provided in the convex portion 52 of the perimeter edge to facilitate deformation thereat so that the material will not be stressed locally, as might make it prone to fracturing.

Figure 4:
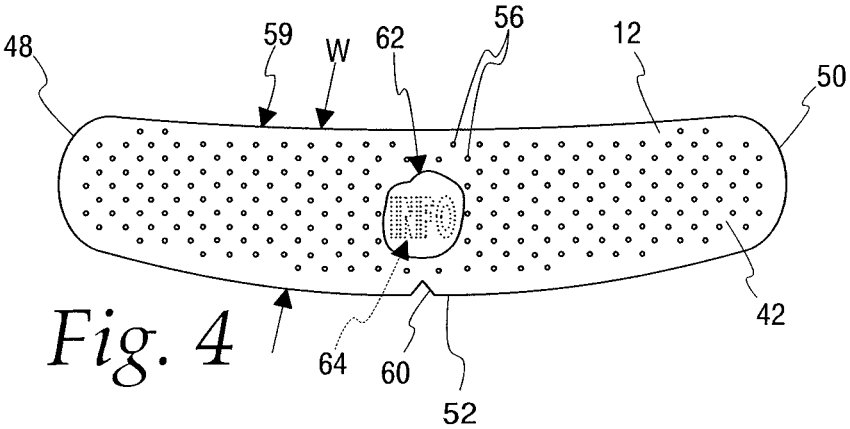
FIG. 4 is an enlarged, rear elevation view of the inventive accessory shown in FIGS. 1 and 2.

On the depicted body, in FIG. 4, a discrete area at 62, of virtually any shape, is provided on the accessory body 42 between the sides thereof whereat there are no openings 56. That is, there is an interruption in the regular pattern of the openings 56 that are provided elsewhere on the accessory body 42. This area 62 provides a convenient location for placement of visible information, identified generically at 64. This information is viewable above the top edge 66 of the layer 36 so as to be viewable from the inside of the space 20 with the accessory 12 in the operative position. The visible information might be in the form of a word, logo, etc. and includes any "information" that might be put on a piece of headwear to identify some aspect of the headwear piece 10 or a place or thing it is used to promote.

Figure 8:
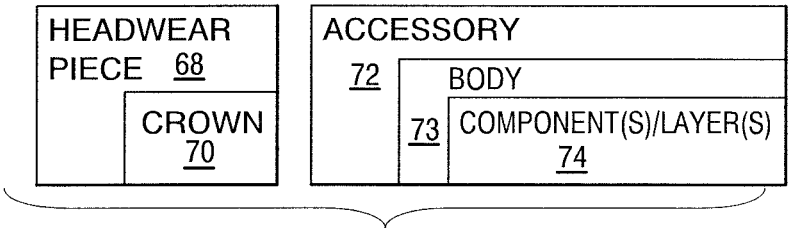
FIG. 8 is a schematic representation of a headwear piece and accessory usable together according to the invention.

As noted above, the invention is directed more generically to any headwear piece 68 with a crown 70, as shown in FIG. 8 in schematic form. A significant aspect is that the crown have a forward region which a wearer's face contacts as the headwear piece 68 is worn. A rim/bill is not a requirement.

Further, the accessory 72 as shown generically in FIG. 8 is intended to encompass the specific form thereof shown in FIGS. 1-7 and described hereinabove as well as other accessories that use the same basic concepts to be incorporated into the headwear piece 68. FIG. 8 also broadly depicts an accessory 72 with any component applied to a body 73, such as the body 42, with any component(s), layer(s) applied to the body 73 to limit migration of moisture and/or other loose matter from a wearer's head to the headwear piece 68.

As further noted above, the accessory 72, while shown to have a single layer, may have multiple components/layers 74 that cooperate to produce the desired functional features—notably shape retention for the frontal crown region and blocking migration of contaminants from the user to the visible crown regions.

Certain examples of variations of the basic accessory 12 are shown in FIGS. 9-15. In each of these Figures, the same body 42 as shown for the accessory 12 is utilized; however, this is not a requirement In FIGS. 9 and 10, an accessory 12' is shown wherein the body 42 has a moisture absorbent layer 76 thereon. The layer 76 is located at the rear side 46 of the body 42 and follows the shape of the convex perimeter portion 52 of the body 42 between the ends/sides 48, 50. The layer 76, as depicted, has a substantially uniform width W1 that is substantially less than the width W of the body 42 as to leave exposed the discrete area 62 for the placement of the aforementioned information 64. Uniform width of the layer 76 is not required.

The moisture absorbent layer 76 may be made from any moisture absorbent material, such as a fabric, polypropylene, etc. As one non-limiting example, styrene has been used to make absorbent sheet layers. Existing diaper technology offers a wide range of absorption material/construction options. Regardless of the exact composition, the layer 76 will tend to absorb and contain any moisture emanating from a wearer's head both directly and that flows downwardly along the surface 78 at the rear side 46 of the body 42.

The layer 76 may be integrated by any known means, such as by adhesive, integral molding, etc.

The presence of the layer 76 tends to avoid migration of moisture, particularly around the convex perimeter portion 52 that might tend to discolor or stain the visible portion of the associated crown 14.

The layer 76 is shown in solid lines to terminate at the ends/sides 48,50. In an alternative form, the layer 76 may continue fully around the body perimeter at the rear side 46, as shown in dotted lines.

Figure 9:
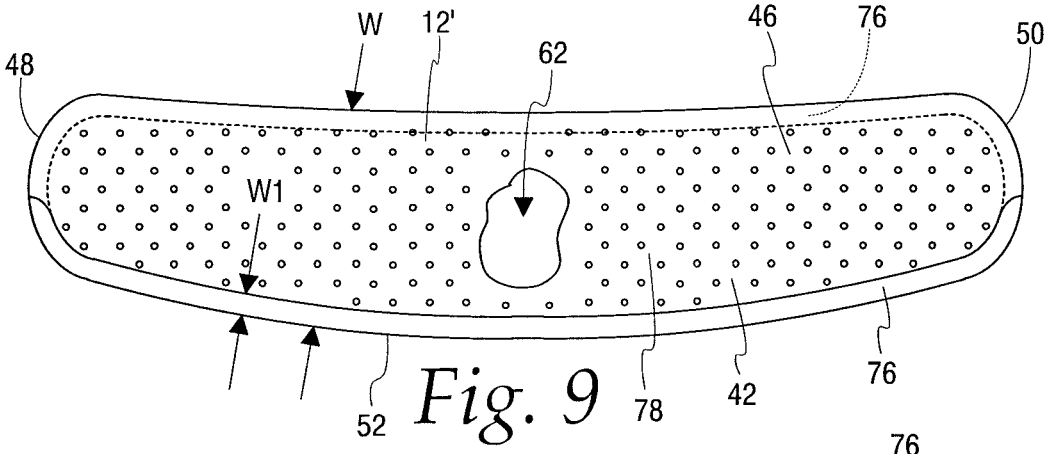
FIG. 9 is a rear elevation view of a modified form of accessory wherein the accessory body of FIG. 4 incorporates a moisture absorbing layer at the rear side thereof.
Figure 11:
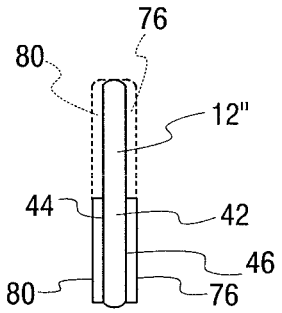
FIG. 11 is a view as in FIG. 10 of a modified form of the accessory having moisture absorbing layers on front and rear sides thereof.
Figure 10:
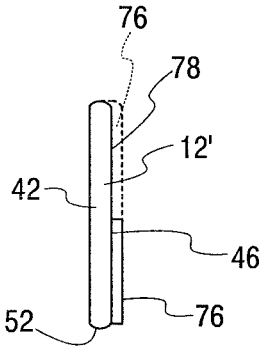
FIG. 10 is a side elevation view of the accessory in FIG. 9.

In FIG. 11 a modified form of accessory is shown at 12", incorporating the layer 76 as shown in FIGS. 9 and 10 and an additional, like, moisture absorbing layer 80, separately provided at the front side 44 of the body 42. The layer 80 may extend partially around the body perimeter, as shown in solid lines, or fully therearound as shown in dotted lines. The shape may be the same as, or different than, that of the layer 76.

Figure 12:
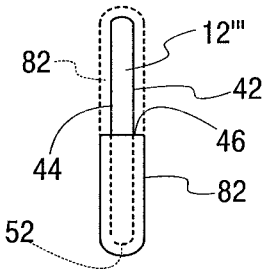
FIG. 12 is a view as in FIGS. 10 and 11 of a further modified form of accessory wherein a moisture absorbing layer continuously extends between the front and rear sides of the accessory body.

In FIG. 12, a further modification of the accessory 12 is shown at 12''' wherein a moisture absorbing layer 82, that appears generally the same as the layer 76 from a rear perspective, is wrapped around the convex perimeter portion 52, as shown in solid lines, to overlie the lower region of the body width W at both the front and rear sides 44, 42, respectively. Alternatively, the layer 82 may wrap around the entire body perimeter, as shown in dotted lines.

Figure 13:
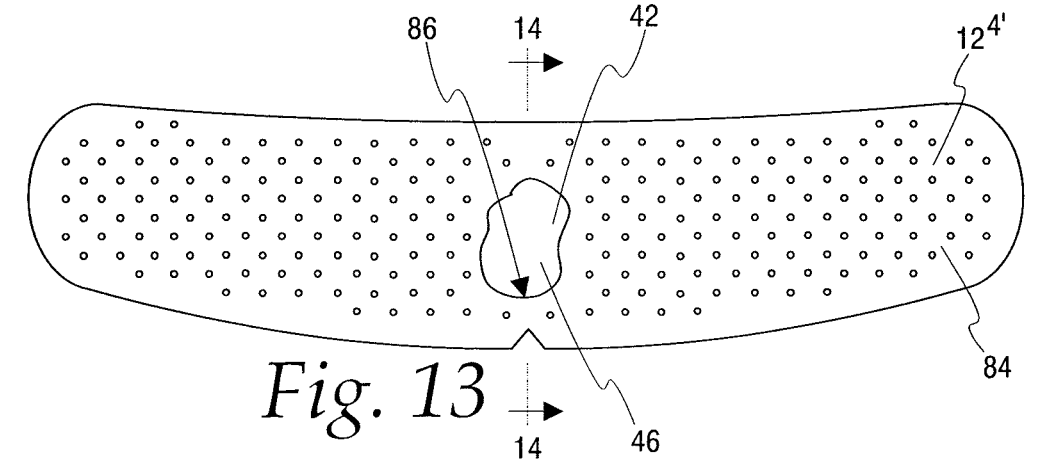
FIG. 13 is a view as in FIG. 9 of a further modified form of accessory having a different form of moisture absorbing layer.
Figure 14:
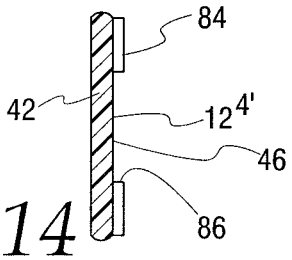
FIG. 14 is a cross-sectional view of the accessory taken along line 14-14 of FIG. 13.

In FIGS. 13 and 14, a further modified form of accessory 12 is shown at $12^{4'}$ and consists of a moisture absorbing layer 84 that overlies substantially the entire area of the rear side 46 of the body 42, with the exception that there is a cutout at 86 to facilitate placement of the aforementioned information 64 directly against the rear side 46 of the body 42. The cutout could be eliminated.

Alternative shapes and locations of at least one moisture absorbing layer incorporated into the body 42 are contemplated.

Figure 15:
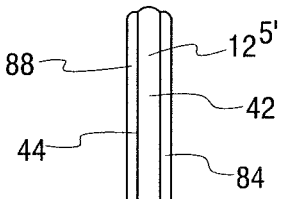
FIG. 15 is a view as in FIGS. 10-12 with the structure of FIGS. 13 and 14 and having an additional moisture absorbing layer on the front side of the accessory body.

As shown in a further alternative form in FIG. 15, the accessory $12^{5'}$ may incorporate the layer 84 and a like layer 88 at the front side 44 of the body 42.

Figure 16:
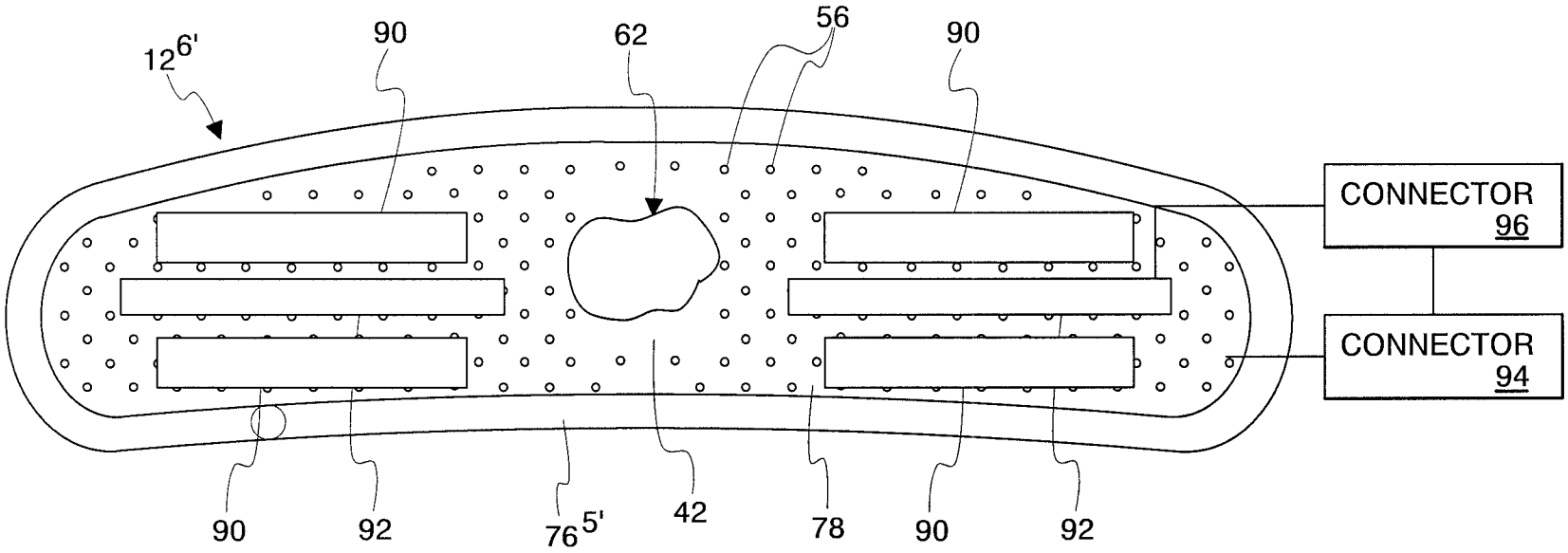
FIG. 16 is a view as in FIG. 9 of a still further modified form of accessory and incorporating a cooling feature.

In FIG. 16, a further modified form of accessory is shown at $12^{6'}$, incorporating a body such as the body 42, or a body of similar construction. The accessory $12^{6'}$ has a moisture absorbent layer $76^{5'}$ that, as depicted, extends around a full perimeter of the surface 78 at the rear side of the body 42. The particular construction of the moisture absorbent layer $76^{5'}$ is not critical to this embodiment and may extend less than continuously around the body perimeter as depicted. Any of the configurations for the moisture absorbent layers 76, 84, described herein, or others, are contemplated.

The accessory $12^{6'}$ incorporates at least one, and in this case four, discrete patches 90 of moisture absorbent material that may be the same as, or different than, the material making up the layer $76^{5'}$. In the embodiment depicted, each of the patches 90 has a generally rectangular shape with the length aligned from side-to-side on the body 42. The shape, and extent of areal coverall of the surface 78 may change, understanding that the greater the area occupied by the patches 90, the more limited are the number of openings 56 that provide breathability.

Thus, for all embodiments, designers must balance between absorbing foreign matter—dirt and perspiration—and promoting cooling of the wearer's forehead region.

As an additional feature, in this embodiment, at least one, and as depicted two, cooling pieces 92 are incorporated, each vertically coincident with, and between, a pair of the patches at each side of the body 42. Again, the shape, number, and areal extent of the pieces 92 is not limited to what is depicted.

The cooling pieces 92 may incorporate well-known technology, such as cooling technology incorporated into cooling gel sheets as currently used to lower temperature as to avoid headaches. The cooling pieces 92 may be ones that can be applied and replaced periodically. For example, some cooling gel sheets can be applied and will remain cool for several hours. The pieces 92 can be replaced as needed.

Other technology requires refrigeration of such cooling pieces 92 to allow them to perform the cooling function. This design also requires separation of the cooling pieces 92 from the body 42 by a user if the cooling feature is to remain active.

The cooling pieces 92 might incorporate a pressure-sensitive adhesive that allows the pieces 92 to be peeled to be replaced or re-cooled.

In FIG. 16, there is a generic showing of cooperating connectors 94, 96, respectively on the body 42 and one exemplary cooling piece 92, that interact to maintain each cooling piece 92 in place. The connectors 94, 96 may be any known type of cooperating connector arrangement that allows permanent or releasable connection.

If there is a permanent connection, the entire headwear piece 10 might be cooled to lower the temperature of the cooling pieces 92 preparatory to use.

A significant aspect of the cooling pieces 92 is that they can maintain, for some appreciable period, a temperature lower than the atmospheric temperature in which the headwear piece 10 is worn.

As noted above, the invention contemplates many additional variations including different shapes and sizes of the various moisture absorbing layers. The different forms are shown and described to identify basic concepts that can be modified in manners that would be obvious to one skilled in the art to benefit from the various assembled components.

Figure 17:
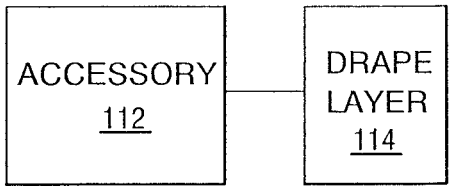
FIG. 17 is a schematic representation of an accessory, according to the invention, with an associated drape layer to control migration of foreign matter from a wearer's head to fabric on a headwear piece.

A further variation of the invention is shown in FIG. 17, wherein an accessory 112 is shown schematically to represent all versions of the accessories 12, 12', 12", 12''', $12^{4'}$, described above, and virtually an unlimited number of variations thereof. The accessory 112 is incorporated into the headwear piece 10 generally as described above. In addition, a drape layer 114 is incorporated to overlie a region at the front portion of the headwear piece otherwise exposed directly to a wearer's head with the headwear piece 10 being worn and in the operative position.

Figure 18:
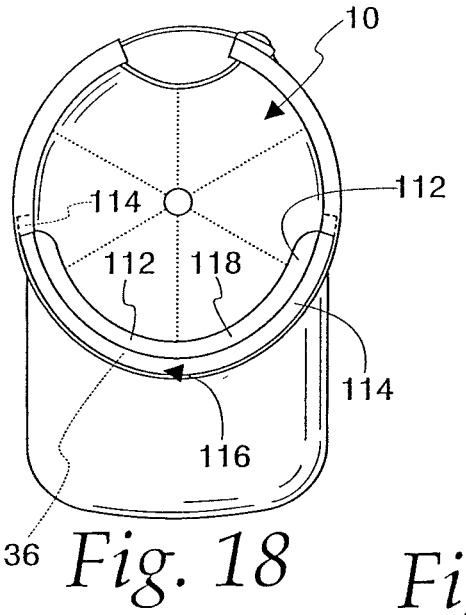
FIG. 18 is a view as in FIG. 2 and showing one specific form of drape layer, as shown schematically in FIG. 17, incorporated.

For example, as seen in FIG. 18, the layer 36 has a surface 116 that is directly contacted by the frontal region of the wearer's head, or is in close proximity thereto with the headwear piece 10 being worn. Perspiration from the wearer's head may be absorbed at this surface 116 and ultimately wicked through the fabric on the headwear piece 10 so as to produce a stain or discoloration that is visible on the inside and/or the outside of the headwear piece 10. The surface 116 that receives the perspiration may be directly in contact with the wearer's head and/or may receive perspiration droplets that migrate thereto or fall thereupon.

The schematic representation of the drape layer 114 is intended to encompass any structure that overlies any part of the surface 116, including regions rearwardly thereof, that may be prone to being dampened by perspiration when the headwear piece 10 is being worn. The schematic representation of the structure in FIG. 17 is intended to encompass the specific structures described hereinbelow as well as virtually an unlimited number of variations of the basic components therein and their interaction.

Figure 19:
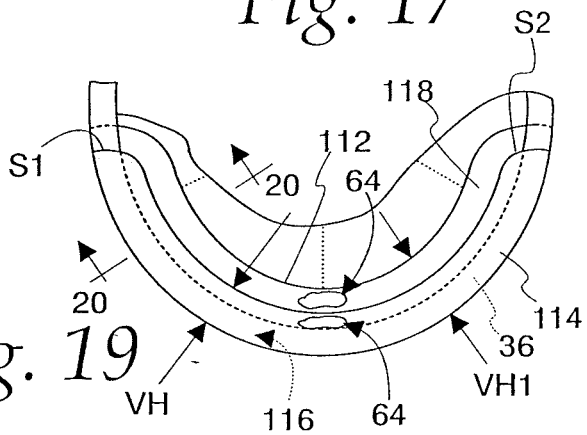
FIG. 19 is an enlarged, fragmentary view of a front portion of the crown on the headwear piece in FIG. 18.
Figure 20:
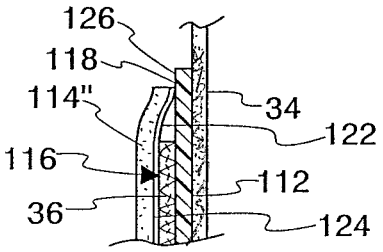
FIG. 20 is a cross-sectional view of the headwear piece taken along line 20-20 of FIG. 19.

As seen in FIGS. 18-20, the accessory 112 is placed in its operative position substantially in the same manner in the headwear piece 10 as in the previously described embodiments for the accessory 12.

The drape layer 114 depicted extends circumferentially around the inside perimeter of the headwear piece 10 to span a substantial portion, if not the entirety, of the forehead and temple regions of the wearer's head. In the embodiment depicted, the circumferential extension of the accessory 112 and drape layer 114 are approximately the same, but this is not a requirement. Further, there is no specific limitation as to the circumferential extension of the accessories in any of the embodiments herein, as the same may extend to a circumferential extent greater than indicated, such as on the order of 180°, or more.

The vertical height VH of the drape layer 114 may vary between its sides S1, S2. As depicted, the vertical height VH is substantially constant over a majority of its extent between the sides S1, S2 and is slightly less than the vertical height VH1 of the accessory 112. The accessory 112 and drape layer 114 are nominally matched in shape, though this is not a requirement. As depicted, the difference in vertical height leaves an exposed strip 118 at the top region of the accessory 112. In FIG. 18, the width of the strip 118 is slightly larger than in FIG. 19, with the drape layer 114 having a width approximately equal to the width of the layer 36 therein.

Figure 23:
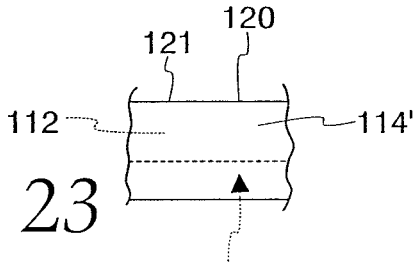
FIG. 23 is a fragmentary, rear, elevation view showing a modified form of accessory on a front layer of a headwear piece.

As shown in FIG. 23, a modified form of drape layer 114' may have a top edge 120 flush with a top edge 121 of the accessory 112. The accessory 112 and drape layer 114' are similarly incorporated to protect at least the surface 116.

Referring back again to FIGS. 18-20, in this exemplary form, an adhesive layer 122 is provided on the forwardly facing surface 124 on the drape layer 114. The adhesive layer 122 thus bonds an upper region of the drape layer 114 to the rearwardly facing surface 126 of the accessory 112 and a lower region of the drape layer 114 to the rearwardly facing surface 116 on the layer 36. The drape layer 114 overlies a top edge 123 of the layer 36 at an entry to the pocket 38.

While for purposes of simplicity the components are described at the frontal region, and at the surface 116 thereat, the same interaction of components is possible by circumferentially extending the accessory 112 and drape layer 114 rearwardly.

The adhesive layer 122 may cover the entire surface 124 of the drape layer 114 or may be strategically applied over less than the entire area thereof.

The construction of the drape layer 114 and its application may vary considerably. A desirable feature of the drape layer 114 is that it limits transfer of perspiration from a wearer's frontal region—principally forehead and temple regions—to the inside fabric of the crown, particularly at the surface 116. The focus herein is particularly on the forehead region wherein the user's skin is directly contacted with the fabric on the headwear piece.

Figure 21:
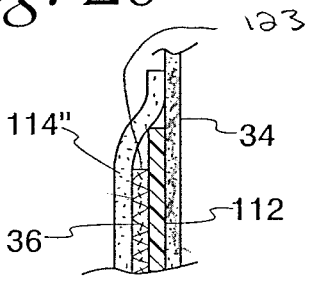
FIG. 21 is a view as in FIG. 20 of a modified form of drape layer and its connection.

In another variation of the invention, shown in FIG. 21, a modified form of drape layer 114" is adhered to the layer 34 above the accessory 112. The drape layer 114" thus extends upwardly even further and otherwise functions generally similarly in terms of blocking moisture transfer to the headwear piece fabric in the frontal region thereof, as at the surface 116 on the layer 36. In FIG. 21, the drape layer 114" may be connected by any suitable means, such as a releasable adhesive, hook-and-loop type fasteners, etc.

The drape layer, in all embodiments, may extend upwardly to beyond the layer 36 and the accessory. This upward extension may be supported as by being adhered as in FIG. 21, or be otherwise maintained in place without requiring secured connection to any component. As just one example, the upward extension may be in a cantilevered arrangement with the upper edge region unconnected.

Further, the drape layer 114 may extend circumferentially further than the accessory 112, as shown in dotted lines in FIG. 18.

Figure 22:
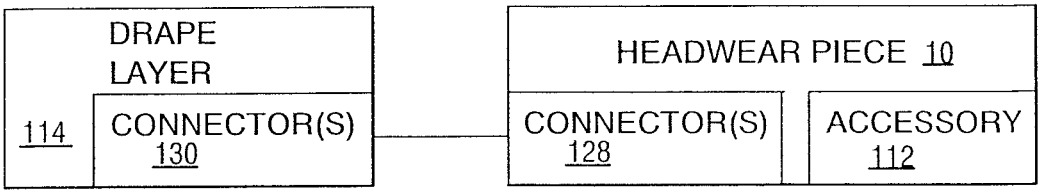
FIG. 22 is a schematic representation of a connecting arrangement between a headwear piece having the inventive accessory incorporating the inventive drape layer.

As indicated in FIG. 22, it is contemplated that the drape layer 114 may be connected in different manners and at different locations to the headwear piece 10, directly to the accessory 112, or otherwise. FIG. 22 shows a generic structure for attaching the drape layer 114 which involves cooperating connectors, including at least one each 128, 130, respectively on the headwear piece 10 and drape layer 114.

Figure 24:
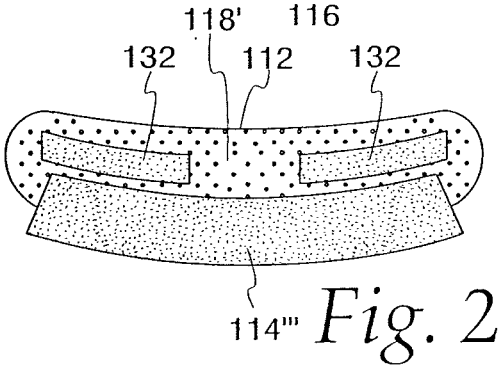
FIG. 24 is a rear elevation view of a modified form of accessory with a drape layer, according to the invention.

In a still further embodiment shown in FIG. 24, a drape layer 114'" is provided on the accessory 112 and is dimensioned to leave a strip 118' that is wider than the strip 118 in the corresponding construction shown in FIG. 19. Within the area of this strip 118', discrete patches 132 are located to perform an absorption and/or cooling function.

In all embodiments, one or more discrete patches of absorbent material and/or coolant might be utilized in different arrangements to achieve the objectives, described above.

The invention contemplates that the information 64 may be applied in different manners at different locations, among which are on the accessory 112 and/or the drape layer 114, as shown in FIG. 19.

The foregoing disclosure of specific embodiments is intended to be illustrative of the broad concepts comprehended by the invention.

The invention claimed is:

1. In combination:

a headwear piece having: a) a crown with a wall having an inside surface bounding a crown space for receiving a part of a wearer's head with the headwear piece in an operative position; and b) a rim/bill projecting from a forward region of the crown; and an accessory having a body with a thickness between front and rear sides and made from a material that substantially blocks migration of moisture from the rear side to the front side, the accessory body having top and bottom edges, the accessory further comprising a component applied to the accessory body to limit migration of moisture and/or loose matter from a wearer's head to the headwear piece, the accessory configured to be placed in an operative position against the inside surface of the crown wall at the forward region of the crown to reduce contaminant transmission from a wearer's head to the inside surface of the crown wall at the forward region, wherein the crown wall has an outer layer that is exposed at the forward region and a layer that is folded upwardly behind the outer layer to produce an upwardly opening pocket, the upwardly folded layer having a top edge at an entry to the upwardly opening pocket, wherein with the accessory in the operative position a part of the accessory body is extended into the pocket, wherein the layer that is folded upwardly behind the outer layer has an inside surface portion making up a part of the inside surface of the crown wall, wherein the component applied to the accessory body comprises a drape layer that overlies the top edge of the upwardly folded layer and resides against the inside surface portion on the upwardly folded layer with the accessory in the operative position and the headwear piece in the operative position on a wearer's head, wherein a part of the accessory is bonded through an adhesive to a part of the headwear piece, whereby the accessory is maintained in the operative position by a combination of: a) frictional forces acting between the accessory body and the headwear piece; and b) the adhesive acting between the part of the accessory and the part of the headwear piece, wherein the front side of the accessory body at the top edge of the accessory body is directly exposed to the inside surface of the crown wall, wherein the drape layer comprises a single sheet with oppositely facing front and rear surfaces, wherein the front surface of the single sheet abuts to the back side of the accessory body and the rear surface of the single sheet bounds a part of the crown space so that the rear surface of the single sheet is directly against a wearer's head with the headwear piece in the operative position.

2. The combination according to claim 1 wherein the accessory and headwear piece are configured so that with the accessory in the operative position the accessory generates forces on the forward region of the crown that produce a desired curved shape at the forward region of the crown.

3. The combination according to claim 2 wherein the accessory body has a sheet construction.

4. The combination according to claim 3 wherein the accessory body comprises a material, the material of the accessory body being flexible and shape-retentive.

5. The combination according to claim 4 wherein the component comprises at least one moisture absorbing layer that is applied to the body at each of the front and rear sides of the accessory body.

6. The combination according to claim 1 wherein the accessory body has a top and a bottom and a dimension between spaced ends/sides and the accessory body has spaced, curved edges extending over a majority of the dimension at the top and bottom of the accessory body.

7. The combination according to claim 1 wherein the crown defines an opening with a diameter through which a wearer's head is directed into the crown space, and with the accessory in the operative position the accessory extends around less than an entirety of the diameter of the crown opening.

8. The combination according to claim 7 wherein the accessory in the operative position extends between 150° and 210° around the diameter of the crown opening.

9. The combination according to claim 1, wherein visible information is located on one of the sides of the accessory body.

10. The combination according to claim 9 wherein the accessory body has a top and bottom, the drape layer is adhered to the rear side on the accessory body and has a top edge that is spaced below the top edge of the accessory body leaving an exposed area on the rear side of the accessory body and the visible information comprises a word and/or a logo on the exposed area on the rear side of the accessory body.

11. The combination according to claim 1 wherein the crown is made from a flexible fabric material.

12. The combination according to claim 1 wherein the component comprises a moisture absorbing layer.

13. The combination according to claim 1 in combination with a cooling piece on the body of the accessory that is at a temperature below a temperature of an atmosphere in which the headwear piece is worn and below a temperature of the body of the accessory.

14. The combination according to claim 1 wherein the drape layer overlies and is adhesively bonded to at least a part of the rear side of the accessory body.

15. The combination according to claim 14 wherein the drape layer is adhered to the inside surface portion on the upwardly folded layer above the top edge of the accessory body.

16. The combination according to claim 15 wherein the drape layer is adhered to the inside surface of the crown above the upwardly folded layer.

17. The combination according to claim 1 wherein a part of the drape layer is fixed to the accessory body.

18. The combination according to claim 17 wherein the part of the drape layer is adhered to the accessory body.

19. The combination according to claim 1 wherein the drape layer comprises a moisture absorbing material.

20. The combination according to claim 1 wherein the drape layer has a top edge that is flush with the top edge of the accessory body.

21. The combination according to claim 1 wherein the accessory body has a top and a bottom and a dimension between spaced ends/sides and the part of the body that is extended into the pocket has a perimeter edge that is continuously convexly curved over a majority of the dimension at the bottom of the accessory body.

22. In combination:

a headwear piece having: a) a crown with a wall having an inside surface bounding a crown space for receiving a part of a wearer's head with the headwear piece in an operative position; and b) a rim/bill projecting from a forward region of the crown; and an accessory having a body with a thickness between front and rear sides and made from a material that substantially blocks migration of moisture from the rear side to the front side, the accessory further comprising a component applied to the accessory body to limit migration of moisture and/or loose matter from a wearer's head to the headwear piece, the accessory configured to be placed in an operative position against the inside surface of the crown wall at the forward region of the crown to reduce contaminant transmission from a wearer's head to the inside surface of the crown wall at the forward region, wherein the crown wall has an outer layer that is exposed at the forward region and a layer that is folded upwardly behind the outer layer to produce an upwardly opening pocket, the upwardly folded layer having a top edge at an entry to the upwardly opening pocket, wherein with the accessory in the operative position a part of the accessory body is extended into the pocket, wherein the layer that is folded upwardly behind the outer layer has an inside surface portion making up a part of the inside surface of the crown wall, wherein the component applied to the accessory body comprises a drape layer that overlies the top edge of the upwardly folded layer and resides against the inside surface portion on the upwardly folded layer with the accessory in the operative position and the headwear piece in the operative position on a wearer's head, wherein a part of the accessory is bonded through an adhesive to a part of the headwear piece, whereby the accessory is maintained in the operative position by a combination of: a) frictional forces acting between the accessory body and the headwear piece; and b) the adhesive acting between the part of the accessory and the part of the headwear piece, wherein the drape layer comprises a single sheet with oppositely facing surfaces, one of the oppositely facing single sheet surfaces directly facing the rear side of the accessory body, the other of the oppositely facing single sheet surfaces directly exposed to and facing a wearer's head with the headwear piece in the operative position, wherein the accessory body is made from a shape-retentive flexible material and the accessory and headwear piece are configured so that with the accessory in the operative position the accessory generates forces on the forward region of the crown that produce a desired curved shape at the forward region of the crown.

* * * * *